US007264379B2

(12) United States Patent
Ruben

(10) Patent No.: US 7,264,379 B2
(45) Date of Patent: Sep. 4, 2007

(54) HIGH BAY LIGHTING EFFICIENCY I

(76) Inventor: Sandoval Ruben, 31880 Yucaipa Blvd., Yucaipa, CA (US) 92399

( * ) Notice: Subject to any disclaimer, the term of this patent is extended or adjusted under 35 U.S.C. 154(b) by 218 days.

(21) Appl. No.: 11/099,725

(22) Filed: Apr. 5, 2005

(65) Prior Publication Data

US 2006/0221621 A1 Oct. 5, 2006

(51) Int. Cl.
*F21V 29/00* (2006.01)

(52) U.S. Cl. ..... 362/294; 362/404; 362/405; 362/373; 362/252

(58) Field of Classification Search ..... 362/235, 362/249, 252, 225, 260, 404, 405, 406, 147, 362/373, 294
See application file for complete search history.

(56) References Cited

U.S. PATENT DOCUMENTS

| | | | | |
|---|---|---|---|---|
| 4,064,430 | A | 12/1977 | Owens | |
| 4,664,465 | A | 5/1987 | Johnson et al. | |
| 5,197,798 | A * | 3/1993 | Tickner | 362/235 |
| 5,356,314 | A | 10/1994 | Aota | |
| 5,377,086 | A * | 12/1994 | Tickner | 362/235 |
| 5,497,048 | A | 3/1996 | Burd | |
| 5,528,473 | A * | 6/1996 | Kassay et al. | 362/247 |
| 5,541,477 | A | 7/1996 | Maya et al. | |
| RE36,414 | E * | 11/1999 | Tickner | 362/235 |
| 6,210,018 | B1 * | 4/2001 | Kassay et al. | 362/216 |
| 6,494,601 | B2 * | 12/2002 | Johnson | 362/406 |
| 7,131,753 | B1 * | 11/2006 | Edwards, Jr. | 362/405 |
| 2005/0259419 | A1 * | 11/2005 | Sandoval | 362/249 |

* cited by examiner

*Primary Examiner*—Thomas M. Sember
(74) *Attorney, Agent, or Firm*—Kirk A. Buhler; Buhler & Associates

(57) ABSTRACT

A lighting fixture where the lighting fixture does not require a single ballast, but instead uses the ballast incorporated in a plethora of efficient light elements. The lighting fixture is used where high bay or low bay lighting may be used, but incorporates multiple light sources to provide an equivalent light intensity. The multiple light sources can be multiple fluorescent, LED, or other efficient light sources to provide a less expensive cost of operation and installation. The higher efficiency lights could be standard socket type fluorescent bulbs that are easily available. The higher efficiency lights would also create less heat that would further reduce the air conditioning or cooling costs for the buiding.

19 Claims, 4 Drawing Sheets

HIGH BAY LIGHTING EFFICIENCY I

FIELD OF THE INVENTION

The present invention relates generally to a high bay lighting fixture using multiple self-ballasting bulbs. More specifically the invention is designed to replace a high-bay, low-bay warehouse or similar lighting fixture. The invention may include a hanging system that allows the entire assembly to be wired into a new or existing building and supply the lights, ballast and the dome. This fixture uses multiple high efficiency standard fluorescent or other high efficiency light bulbs.

BACKGROUND OF THE INVENTION

Lighting is used to provide light when it is dark or to provide supplemental lighting for a dark area. Often in large buildings, overhead lighting is provided from lights placed near the ceiling of the building and the light is directed downward. Most light bulbs used in these lighting installations are inefficient, and a portion of the energy used in these lights is expended in heat. In the summer, the heat must be cooled with the building air conditioning system. The replacement cost of these bulbs is also high due to the limited number of these bulbs that are produced. Upgrading these lighting systems has been expensive due to the cost to remove the lighting fixture and replace the entire lighting fixture. What is needed is a new lighting fixture that includes the ballast and may further include the dome. The ballast is provided with multiple high efficiency fluorescent bulbs that provide equivalent or superior illumination with improved efficiency and a reduction in the amount of heat that is generated. The invention proposed by this invention provides a solution to all the listed requirements.

U.S. Pat. No. 5,497,048 issued to Burd is for a fluorescent bulb that has multiple fluorescent elements located within the light bulb. This invention provides the equivalent energy efficiency and an equivalent amount of light, but the bulb is a custom light bulb, and the light bulb is not manufactured in high volume. The invention does not provide multiple efficient light bulbs that are cost effective and easily available.

U.S. Pat. No. 5,541,477 issued to Maya et al. is for a single fluorescent bulb that also has multiple fluorescent bulb elements that are connected into a single screw-in base. This invention provides the equivalent energy efficiency and the equivalent amount of light, but the bulb is a custom light bulb, and the light bulb is not manufactured in high volume. The invention does not provide multiple efficient light bulbs that are cost effective and easily available.

U.S. Pat. No. 4,664,465 issued to Johnson et al. is for a bulb with a clip attached that allows the bulb to be attached to a metal strip. The patent covers the clip connected to a hollow tube that can extend from a vertical or horizontal surface. This invention uses a single bulb connected to an elongated metal tube or neck. The invention is intended for wiring to an electrical power source. The invention does not include multiple light sockets that connect into a base that can be screwed into a lamp base.

U.S. Pat. No. 5,356,314 issued to Aorta is for a double-socket electric lamp that screws into an existing lamp base and converts the lamp into a standard lamp socket so a more standard bulb can be screwed into the second socket. This invention is for converting a high output light bulb into a low output light bulb. The invention replaces a single light bulb with another single light bulb. The invention is a converter for converting a light bulb socket from one size to another. The invention is not intended for converting a single light bulb socket into multiple light bulb sockets.

The ideal product would be used where high or low bay lighting would be used that would normally require a ballast for operation. Standard high efficiency light bulbs could be inserted into the multiple sockets to provide equivalent light intensity at a significant reduction in the energy being used.

BRIEF SUMMARY OF THE INVENTION

It is an objective of the present invention to provide an improved lighting system. This system is used instead of a single light bulb requiring a ballast. The lighting fixture is a single fixture configured for multiple standard higher efficiency bulbs. The invention may also include a dome or other reflector to focus the light downward. The fixture involves a multiple light socket candelabra that are wired where warehouse lighting may be used that may require a ballast.

A standard 100-watt incandescent bulb uses 100 watts of energy, a fluorescent light bulb that provides the same amount of light only requires about 25 watts of energy fluorescent light consume 70 to 75% less energy than a standard incandescent light bulb. The light from fluorescent light is similar or superior to the light from an incandescent light, and can be tinted to provide different shades of light to simulate other lighting sources. The fixture requires the installation onto the rafters or ceiling of the building where it is installed in the factory lighting system. A candelabra lighting fixture is then snapped into the existing dome. A reflector dome located in the lighting fixture helps to focus the lighting down to where the light in needed.

A warehouse typically uses a 450-465 watt incandescent, halogen or similar light bulb and ballast system. The proposed invention replaces the single 400-watt light bulb with five fluorescent lights providing the same amount of light. The standard warehouse light uses 450-465 watts to produce the light. The five fluorescent lights only require 230 to 240 watts of energy to produce the same amount of light saving 170 to 225 watts of energy that would be spent in heat. Inside an air conditioned building the 170 to 225 watts of heat would need to be cooled with the air conditioning system within the building. The savings come from two places first the more efficient lights, and second from air conditioning costs. In addition, there can be safety benefits from less ultraviolet rays, and less chance that the fluorescent bulbs will not explode.

When the invention is installed into a new or existing building where the need for a ballast or the enclosure that would normally enclose the ballast. The multiple bulbs can be as little as two to as many bulbs that are required to provide equivalent light output and voltage drop for the incoming voltage. If the lighting is 277 VAC, multiple 277VAC fluorescent bulbs can be used to achieve equivalent or superior light output.

The construction of the invention consists of ajoist or ceiling mounting system where the fixture can be suspended from a chain. The electrical wires from the building are wired into the top of the fixture, where it is wired into each of the sockets in the candelabra fixture. The candelabra arrangement consists of at least two bulb sockets that extend from a base structure. The bulbs can extend from fixed or flexible arms, goosenecks. The bulbs can be threaded into multiple sockets from the base. The sockets can be wired in a series, parallel, or combined series and parallel arrangement that keeps the voltage to a safe level for the lights screwed into the sockets.

A reflector or dome can be integrated onto the lighting fixture to eliminate the hanging fixture normally associated with high bay lighting fixtures. The reflector or dome is retained on the lighting fixture with retaining snap locks and gravity. The reflector focuses light down from the fixture, while a dome helps to defuse the light and provide more even lighting.

Various objects, features, aspects, and advantages of the present invention will become more apparent from the following detailed description of preferred embodiments of the invention, along with the accompanying drawings in which like numerals represent like components.

DETAILED DESCRIPTION

Figure 1:
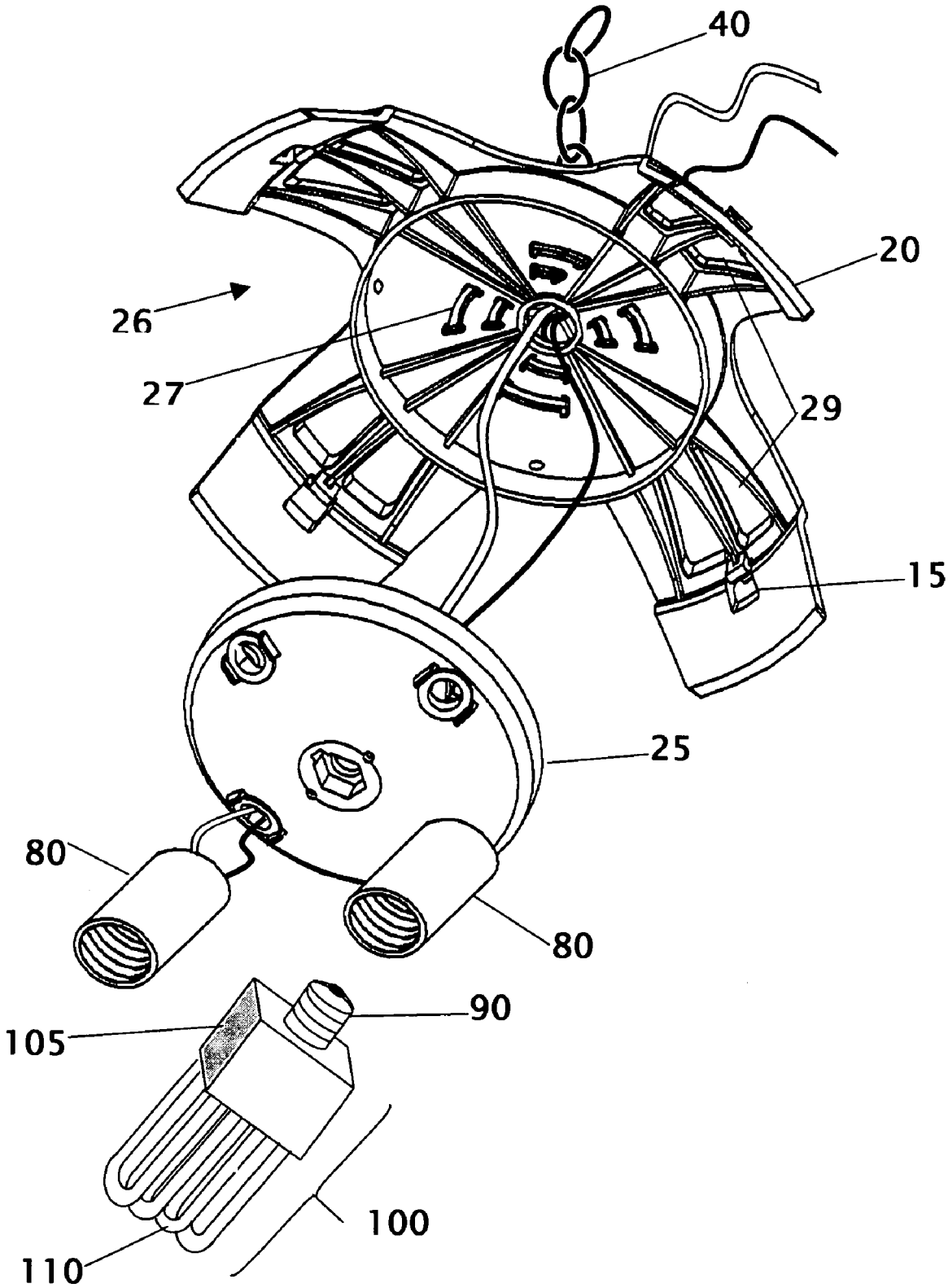
FIG. 1 is an isometric exploded view of the lighting fixture.

Referring first to FIG. 1, that shows an isometric exploded view of the lighting fixture. The fixture works with store, warehouse or industrial lighting system. The lighting fixture is intended for use as high bay, low bay lighting or similar lighting fixture where incandescent, halogen, sodium, metal halide, mercury vapor or other less efficient light bulbs are used. Four tabs 15 are arranged on the upper housing of the fixture 20 for locating and retaining a dome or reflector. Four tabs (one on each wing) are shown for locating the dome. But more or less tabs can be used. It is also contemplated that a ridge can be incorporated in to the housing to retain the dome without any tabs. The reflector helps to improve the efficiency of the lighting by directing light downward. The reflector comprises an ultra-efficient surface finishes that provide optimum efficiencies. The reflective dome can provide narrow to wide distribution of the light based upon the application and the spacing of the lights. The reflective dome is attached to upper housing 20 that includes an attachment tab for a mounting chain 40 integrated or attached to the upper housing 20. Vents 29 are shown in this figure.

The vents 29 allow naturally hot air convection to occur and vent out of the fixture. Without the vents in the fixture, the lights within the dome create heat that remains trapped within the fixture and dome. The heat can exceed several hundred degrees and cause melting, distortion, damage and ultimately failure to the fixture and lights.

The housings shown here are in two different sections, but the housing may be a single housing, or may include more than two sections where a lower section 25 includes connection means for the bulb sockets 80 and an upper section 20 that includes mounting for the dome and the hanging attachment for use with a chain 40 or similar hangar to suspend the assembly to the ceiling or a joist. The chain 40 is shown connected through loop 32 that exists on the top of the fixture. The loop 32 allows for a variety of attachment methods including but not limited to chain, wire, cable, or clips that can allow the fixture to permanently or temporarily connected. The upper and lower sections are configured as a junction box or J-box to allow the wiring to be safely enclosed within the two sections. The housings may be constructed from die-cast aluminum, which allows greater heat dissipation and provides greater corrosion resistance. To improve heat dissipation and resistance corrosion, an acrylic powder coat finishes can be applied to both the inside and outside surfaces of the housing. The housing may contain a built-in thermal venting chamber cast into the housing. In the preferred embodiment the housing is molded from a high temperature plastic material. Venting may be included to allow natural cooling of the fixture, and in the embodiment shown the openings 26 exist in the upper housing to allow air to free flow through the lighting fixture. Air movement allows operation of fixtures in higher ambient temperatures. Internal vents 27 are shown in the upper housing to allow air to exit out of the upper housing.

The hanging attachment consists of a simple structural member or loop that a chain can pass under or through to support the entire assembly from the ceiling. The body is a metal, ceramic, plastic or other type base that can support the components and operate in the temperature that the lighting fixture will operate. The body will have more than one female threaded socket 80. In the preferred embodiment, the threaded female socket is a mogul base, but may be intermittent, medium, candelabra, bayonet or a pin type base. The Mogul base is used because the Mogul base is a very common standard commercial light bulb base that is available from a variety of sources. A number of companies make fluorescent light bulbs with Mogul male threaded bases. A tube may extend from the lower housing 25. The tube may be straight or bent as a gooseneck. The tube may be made from multiple pieces or may be a bendable or adjustable to change the direction of the light. At the end of the tube a threaded female socket 80. In the preferred embodiment, five bulbs are used with one bulb located in the center of the fixture and four bulbs are located around the center bulb, where each of the peripheral sockets is located 90° apart. Three bulbs can be located 120° apart. Bulbs can be added that could be spaced equally or grouped on one or more sides. A male socket 90 is shown as part of a standard fluorescent bulb 100. The replacement bulb has an area for the ballast 105. The ballast controls power to the fluorescent tubes 110.

Figure 2:
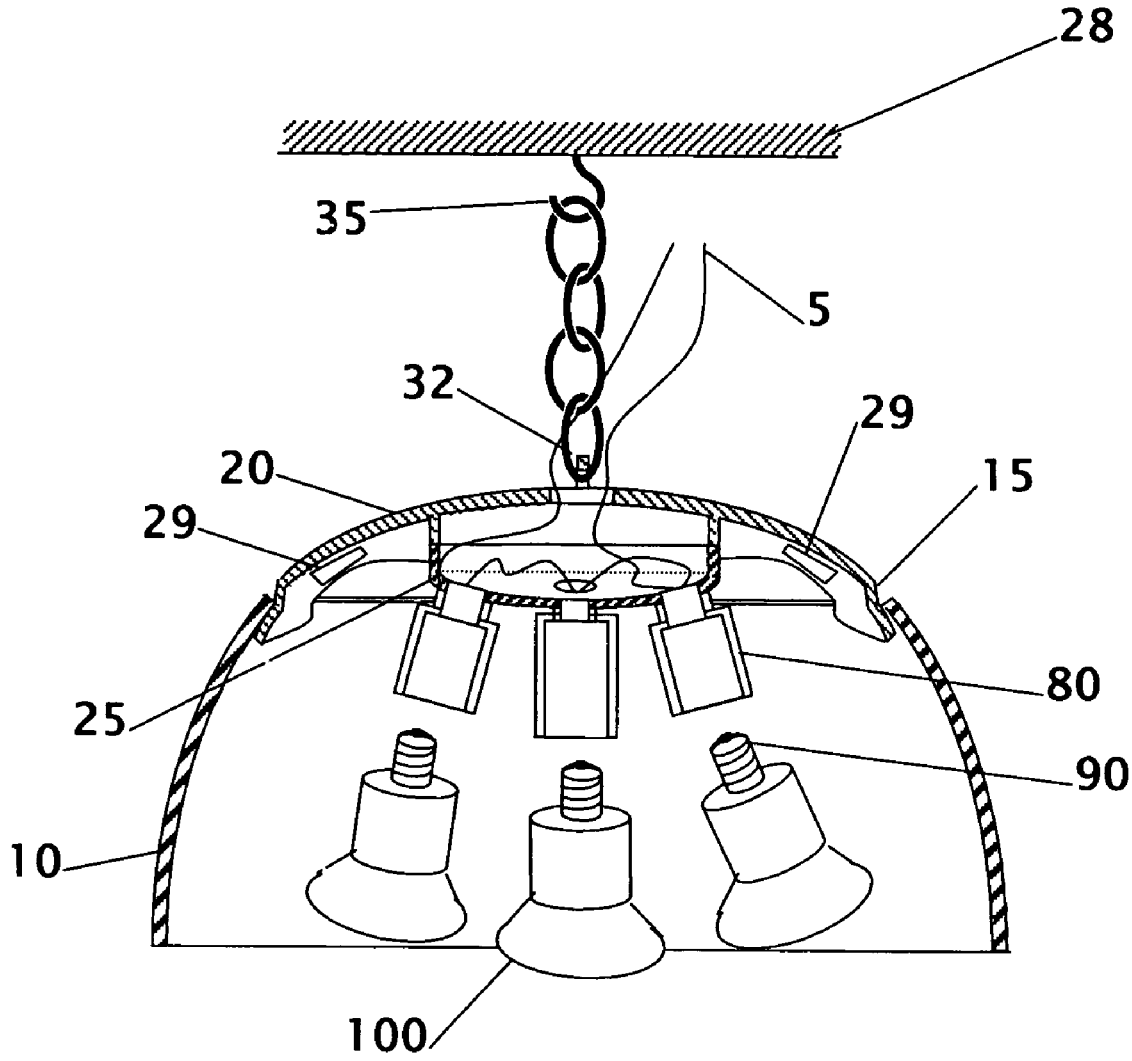
FIG. 2 is a cross sectional view of the lighting fixture showing the internal components.

Referring now to FIG. 2 that shows a cross sectional view showing the internal components. The reflective dome 10 is shown in this figure attached to the lighting fixture. The dome is connected to the upper housing 20 with tab(s) 15. The chain 40 is shown connecting the upper housing 20 with a hook 35 in the ceiling. A single ballast is not required with this fixture because each fluorescent light bulb installed into the fixture includes an integrated ballast. The housing in this figure is shown attached to a rafter 28. The housing shown provides the structural support to retain the lighting fixture and the dome. The wiring 5 is shown exiting the housing. While the wiring is shown exiting the upper housing for connection to an external junction box, J-box or other connection, the wiring may be brought into the housing from the wiring of the building and connected within the light fixture in its internal junction box, j-box or other connection. The lower portion of the housing has a bulb socket member (s) 80 that has a female light socket. The standard fluorescent light bulb 100 is shown in this figure. The bulb in this figure is a flood or spotlight configuration. The base 90, of a standard bulb is shown removed from the female threaded socket in the fixture.

Figure 3:
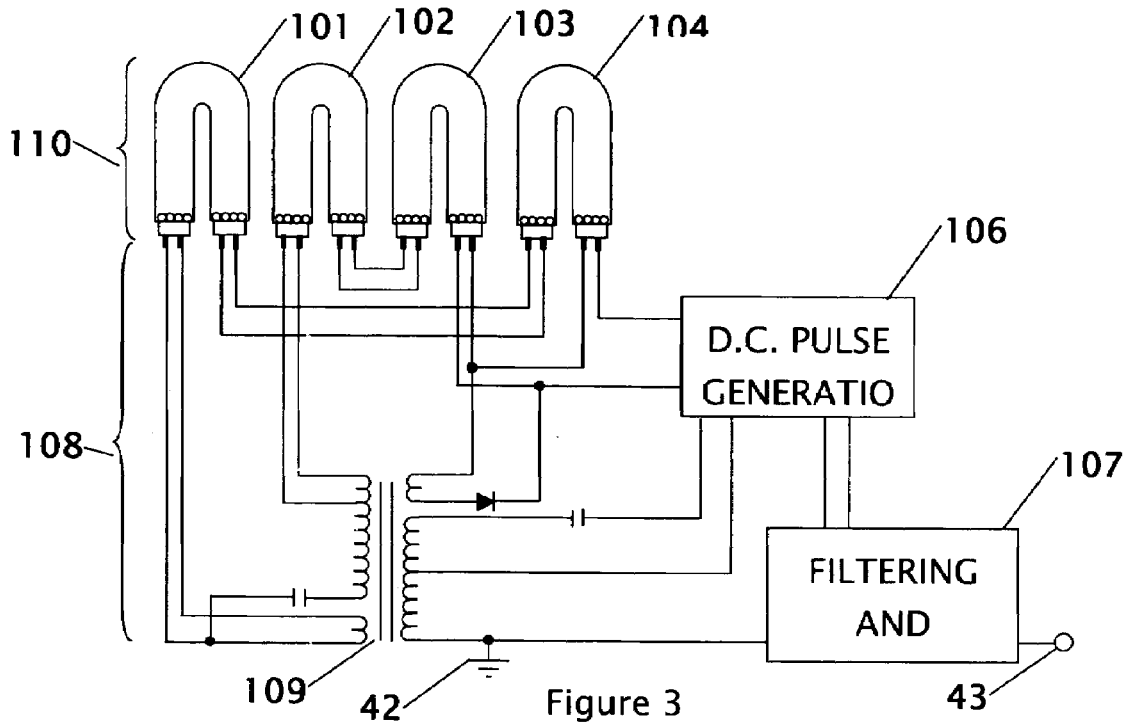
Figure 3 Prior Art
FIG. 3 is an electrical diagram of the internal ballast of a florescent light bulb.

Referring now to FIG. 3 that show an electrical diagram of the internal ballast of a fluorescent light bulb. In the US, the ballast is made for 120, 208, 240, 277 or 480 volts. In Canada, ballast options include 120, 277 and 347 volts. In a standard fluorescent bulb, ballast 108 is located with the base of the bulb. The ballast contains a DC pulse generation circuit 106, and a filtering and voltage regulation portion 107 and a transformer 109. The tip of the male bulb 43 is connected to the filtering and voltage regulation circuit. The threaded portion of the male bulb is connected to the ground point 42. The light emitting portion of the bulb 110 may contain one or multiple bulbs 101 102 103 104. All these components may be found in a standard replacement fluorescent light bulb that can be connected into the replacement fixture.

Figure 4:
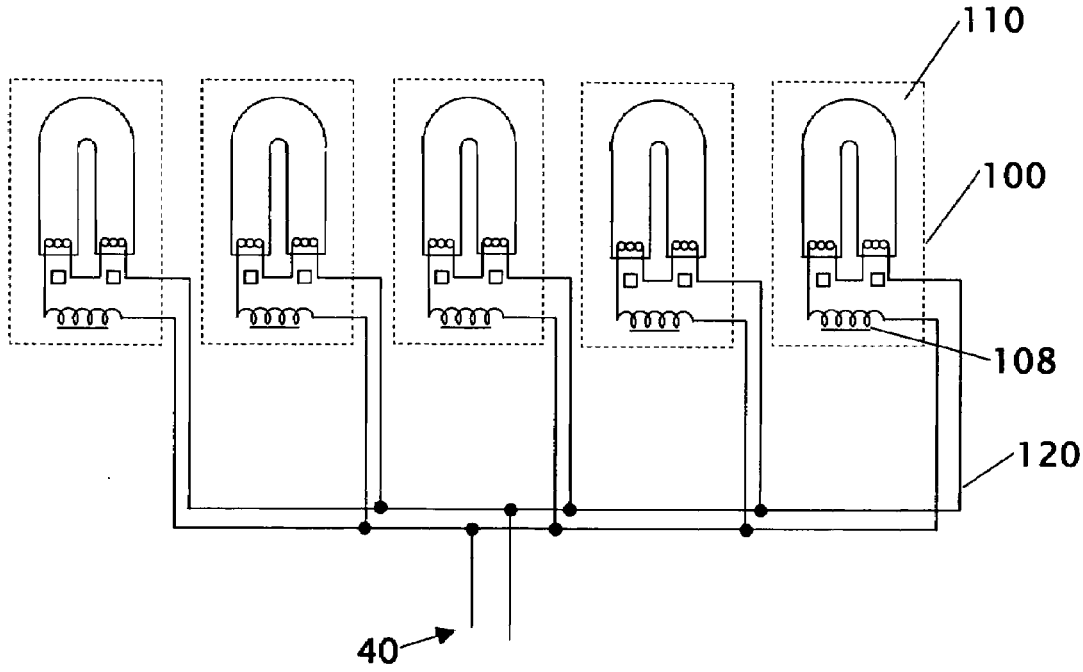
FIG. 4 is a schematic representation of the wiring within the lighting fixture.

Referring now to FIG. 4 that show a schematic representation of the wiring within the fixture. When the fixture is wired into an existing building the ballast and the ballast junction box can be removed. The fixture has wiring that connects from the buildings electrical system to the multiple bulb fixtures. The multiple bulbs can be as little as two to as many bulbs are required to provide equivalent light output and voltage drop for the incoming voltage. If the lighting is 277 VAC, multiple 277VAC fluorescent bulbs can be used to achieve equivalent or superior light output. The most cost effective standard replacement bulb is a fluorescent bulb, but other efficient light sources such as LED's or other efficient lighting devices may be used.

The construction of the fixture consists of using electrical connectors that would be used with the existing light electrical system. An electrical connection is made with the corded connector of the fixture. The wires are then connected to a candelabra arrangement of light bulb sockets. The candelabra arrangement consists of at least two bulb sockets that extend from a base structure. The bulbs can extend on fixed, flexible arms or goosenecks. The bulbs can be threaded into the multiple sockets from the base. The sockets can be wired in a series, parallel, or combined series and parallel arrangement that keeps the voltage to a safe level for the lights screwed into the sockets.

Figure 5:
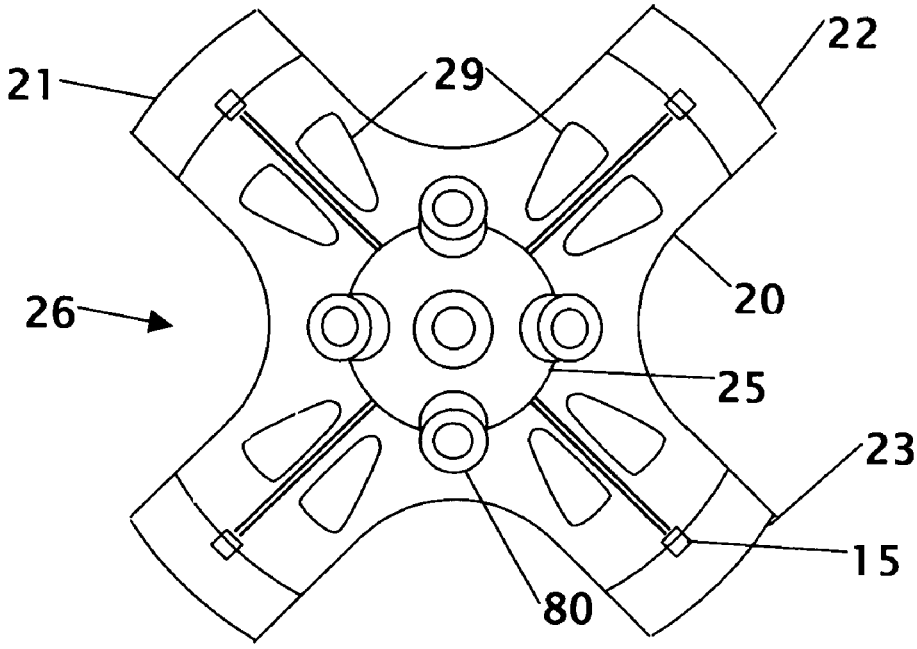
FIG. 5 is a bottom view of the lighting fixture
Figure 6:
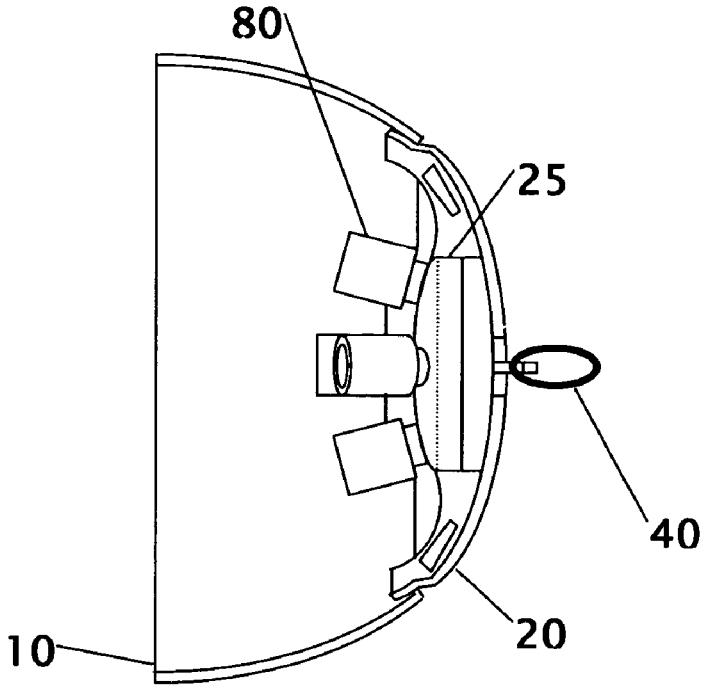
FIG. 6 is a side view of the lighting fixture.

Referring now to FIGS. 5 and 6 that shows a bottom view and side view of the lighting fixture respectively with the dome or reflector removed in FIG. 5. One link of chain 40 is shown in FIG. 6. This link 40 is shown connected through loop 32 that exists on the top of the fixture. The lower housing of the fixture 25 is shown connecting the male sockets 80. In FIG. 5 the four wings of the fixture 21, 22, 23 and 24 can be seen with the clearance area 26 that allows air movement past the fixture. Eight vents 29 positioned around the fixture allow heat to vent from the fixture to reduce damage from the heat generated by the fluorescent lights. The venting is specifically engineered to keep multiple self-ballasting fluorescent bulbs at a constant cool operating temperature. The cooler operating temperature can significantly extend the life of self-ballasting bulbs. While eight vents are shown within the fixture, multiple other venting options are contemplated that provide a more constant operating temperature. These options may include fabricating the fixture from a wire or steel mesh with multiple holes, or fabricating the fixture from tubes or rods to suspend the dome.

Thus, specific embodiments and applications of a replacement light fixture have been disclosed. It should be apparent, however, to those skilled in the art that many more modifications besides those described are possible without departing from the inventive concepts herein. The inventive subject matter, therefore, is not to be restricted except in the spirit of the appended claims.

What is claimed is:

1. A light fixture comprising:

an integral j-box lighting fixture that expands into a candelabra configuration for use with more than one threaded self-ballasting light bulbs where the integral j-box is electrically connected to each of a more than one threaded said light bulbs sockets for the self-ballasting light bulbs;

wherein the integral j-box includes a top configured with at least two wings that extend from the j-box to engage a reflective dome wherein the arms include open areas between the arms for thermal cooling of the fixture.

2. The integral j-box lighting fixture in claim 1 wherein the lighting fixture is intended for nominal voltage greater than 120 VAC.

3. The integral j-box lighting fixture in claim 1 wherein the lighting fixture in intended for a nominal voltage equal or less than 120 VAC.

4. The light fixture from claim 1 further includes self-ballasting fluorescent lights.

5. The integral j-box lighting fixture from claim 1 wherein the light fixtures can be wired into the lighting circuit of a building without a ballast.

6. The more than one light bulb socket from claim 1 wherein the more than one light bulb sockets are mogul, medium mogul, medium, medium skirt, plug in, candelabra or bayonet base.

7. The light fixture from claim 1 that further includes attachment means for a dome or reflector.

8. The electrical connection from claim 1 wherein the wiring from the base to the more than one light bulb socket is series, parallel, or a combination of series and parallel wiring.

9. The lighting fixture from claim 1 that further includes more than one ventilation hole to allow for convection cooling.

10. The lighting fixture from claim 1 wherein the wings are located between the said light bulb sockets to provide for reflecting of the illumination and the open areas are located above the said light bulb sockets to allow for consistent thermal cooling of the self-ballasting light bulbs.

11. A lighting fixture with integrated hanging system comprising:

a lighting fixture for use with multiple lighting elements;

an attachment system incorporated into the lighting fixture that provides a hanging mechanism for a single dome that extends over all the illumination elements in the lighting fixture and the attachment system includes a plurality of wings that extend from the hanging mechanism to secure the single dome wherein open gaps exist between the plurality of wings to provide for venting of heat trapped under the dome.

12. The lighting fixture of claim 11, wherein the multiple lighting elements are fluorescent.

13. The attachment system from claim 11, wherein the attachment system is mechanical snaps or tabs.

14. The lighting fixture from claim 11 wherein the light fixture has a medium, medium skirt, plug in, candelabra or bayonet base.

15. The multiple lighting elements from claim 11 wherein the multiple elements have medium, medium skirt, plug in, candelabra or bayonet base.

16. The homogeneous dome from claim 11 wherein the homogeneous dome is round, square, rectangular, spherical, triangular or a combination thereof.

17. The homogeneous dome from claim 11 wherein the homogeneous dome is plastic, glass.

18. The lighting fixture from claim 11 that further includes more than one ventilation hole to allow for convection cooling.

19. The lighting fixture from claim 11 wherein the wings are located between the said light bulb sockets to provide for reflecting of the illumination and the open gaps are located above each of the said multiple lighting elements to allow for consistent thermal cooling of the said multiple lighting elements.

* * * * *